United States Patent [19]

Rosen

[11] 4,253,504

[45] Mar. 3, 1981

[54] DRAIN FUNNEL

[76] Inventor: Joel B. Rosen, 595 Beaver La., Ronkonkomo, N.Y. 11779

[21] Appl. No.: 53,338

[22] Filed: Jun. 29, 1979

[51] Int. Cl.[3] ..... B67C 3/04; B65B 3/06

[52] U.S. Cl. ..... 141/106; 141/332; 141/364; 211/73; 248/311.3

[58] Field of Search ..... 141/106, 329, 330, 332, 141/364, 98; 211/73; 248/152, 311.3; 222/108–111

[56] References Cited

U.S. PATENT DOCUMENTS

| | | | |
|---|---|---|---|
| 1,742,150 | 12/1929 | Rollins | 248/311.3 |
| 2,365,533 | 12/1944 | Elsebusch | 141/106 |
| 2,591,526 | 4/1952 | Fales, Sr. et al. | 141/106 |
| 2,664,207 | 12/1953 | Bustmante | 248/311.3 |
| 2,728,488 | 12/1955 | Hankins | 141/106 |

*Primary Examiner*—Houston S. Bell, Jr.
*Attorney, Agent, or Firm*—Joseph B. Forman

[57] ABSTRACT

The invention relates to improved drain funnels and is formed by an elongated unitary main body member which has a spout integral with and at one end of the elongated unitary main body member. The elongated unitary main body member is substantially arcurate or "V" shaped and has a support integral with or mounted at or near the edges of the elongated unitary main body member to permit cans or the like to be mounted on the support so that the cans or the like may be drained.

5 Claims, 5 Drawing Figures

DRAIN FUNNEL

The herein described and claimed invention relates to drain funnels and more particularly to drain funnels which may be utilized for draining a plurality of containers at the same time.

BACKGROUND OF THE INVENTION

It has often been inconvenient to drain the remaining contents of a container after the major portion of the contents have been removed. The remaining contents referred to are the contents which adhere to the sidewalls of the container as well as to the top or bottom of the container. One example of such a condition is found when one empties a can of motor oil. The problem is multiplied if an individual is performing an oil change on a motor vehicle when a plurality of cans are utilized to replace the drained oil. It is not intended that the foregoing example be taken as a limitation of the use of my new and improved drain funnel.

It is an object of my invention to provide an extremely simple and low cost apparatus for recovering the contents of containers which are generally lost due to the adherance of such contents to the interior of the container.

A fuller understanding of my invention as well as other objects and advantages of the invention will be obvious to those skilled in the art from a reading of the following specification when taken with the drawings herein.

THE DRAWINGS

FIG. 1 of the drawing shows one embodiment of my invention as utilized with a collection vessel.

DESCRIPTION OF THE INVENTION

Figure 1:
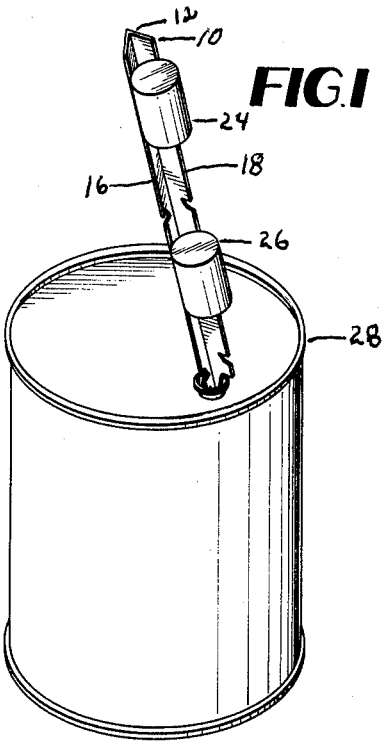
Figure 2:
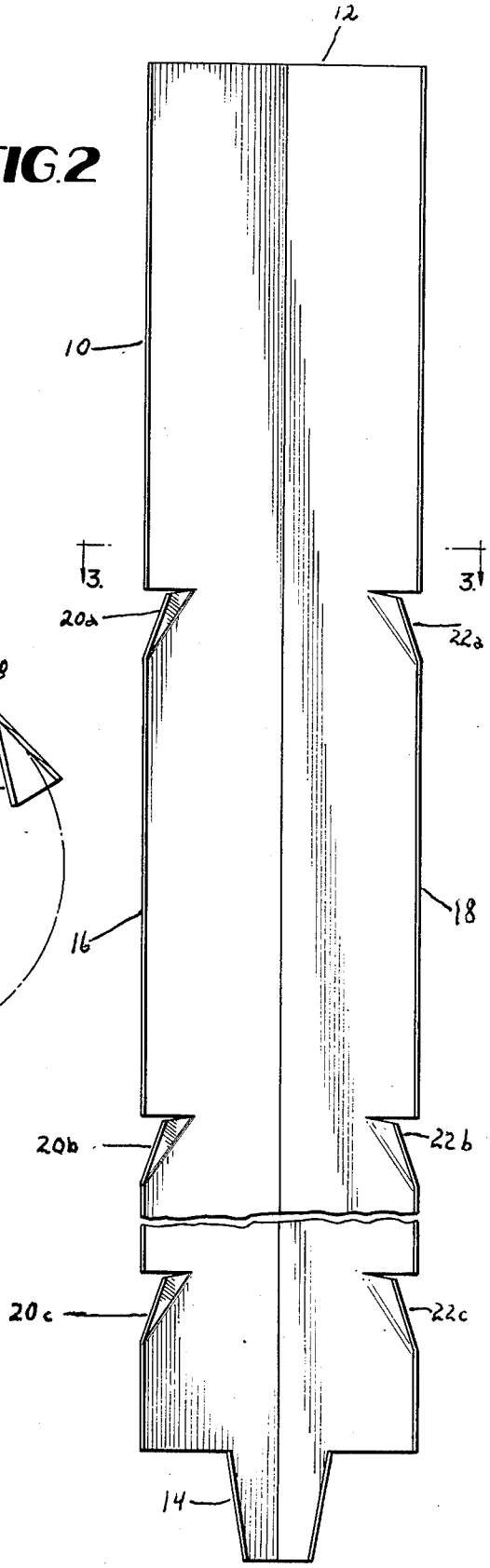
FIG. 2 is a front view of the drain funnel as shown in FIG. 1.
Figure 3:
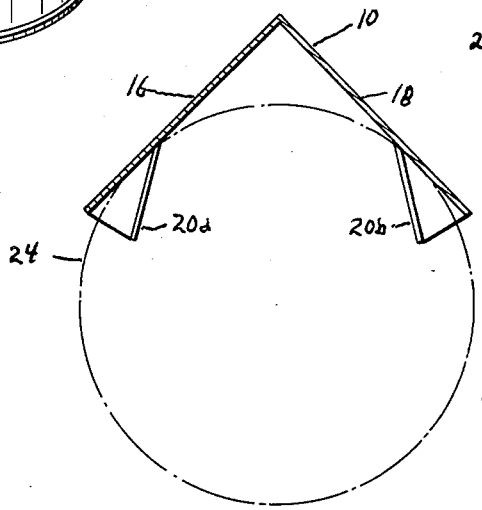
FIG. 3 is a sectional view taken along the line 3—3 of and including an outline of a container supported thereon.

Referring to FIGS. 1, 2 and 3, wherein one embodiment of my invention is shown, the reference numeral 10 is utilized to designate the entire structure of the apparatus, and more particularly a main body member, which main body member 10 is provided with a top end 12 and a lower end or spout 14. The main body member 10 is elongated between top end and spout end and may be in the shape of a V or U or of arcuate shape from one elongated side extremity 16 to the other elongated side extremity 18. The main body member may be formed of metal, fiber, hardboard or the like, and may be left bare or coated on the inside of the arc surface with a resistant coating which will be impervious to the contents of the containers or other objects to be drained.

Along the side extremities 16 and 18, and more particularly at positions opposite one another and spaced apart from one another, the side edges are cut or deformed and bent inwardly at the lowermost side of the cut to provide supports 20*a*, 20*b*, 20*c*, and 22*a*, 22*b*, 22*c*, so that containers such as 24 and 26 may rest thereon as shown in FIG. 1. The contents of containers 24 and 26 are then drained by means of the apparatus of the invention into a receptacle 28.

Figure 4:
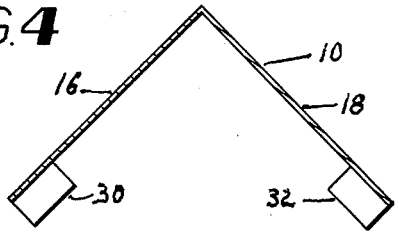
FIG. 4 is a sectional view of an alternate embodiment of my invention as it relates to a portion of the total structure of the apparatus.
Figure 5:
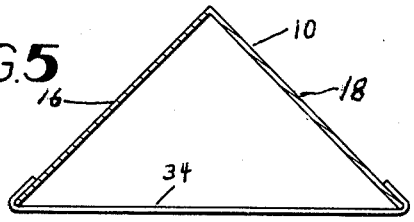
FIG. 5 is a sectional view of another alternate embodiment of the invention as it relates to a portion of the total structure of the apparatus.

While the apparatus shown in FIGS. 1, 2 and 3 have related to one means of forming the support portions 20*a* through 20*c* and 22*a* through 22*c* along the elongated side extremities 16 and 18, alternate embodiments of the apparatus, utilizing other support means are shown in FIGS. 4 and 5. In both FIGS. 4 and 5, the main body member is somewhat similar to that shown in FIGS. 2 and 3, the support means being studs 30, 32 at similar positions occupied by the deformed or bent inward supports.

In lieu of the support means utilized in FIGS. 1 through 4, the support means may comprise a cross-member 34 extending between the elongated side extremities at positions similar to those occupied by the studs of FIG. 4.

In operation, the spout 14 is inserted into container or recptacle 28 with elongated body member positioned at an angle respective the horizontal plane. Containers 24 and 26 which had theretofore been opened and wherein there remain some contents are then positioned across opposing support means along the elongaded edges or side extremities 16 and 18. The drained contents are thus recovered in the receiving container.

It will be obvious for those skilled in the art that I do not intend my invention to be limited by the number of supports along the edge of the main body member that I have shown, nor by the materials I have described as being utilized for forming the base member. Likewise the choice of the material utilized for the main body member will dictate whether or not a coating on the base member is necessary. While I have shown an open spout, optionally the spout could be a closed spout with the end open to permit draining. Other variations will also present themselves to those skilled in the art, and I therefore desire and request that the claims herein be given as broad an interpretation as is consistent with the spirit and scope of the invention.

What is claimed is:

1. A drain funnel comprising an elongated unitary main body member having side edges and a top end and a lower end and having a spout integral with and at the lower end thereof, said elongated body member being arcuate from one side edge to the other side edge for permitting the contents of a fluid container mounted on said funnel to flow to said spout, and support means integral with said body member along the side edges of said main body member on line with one another at positions opposite one another and spaced apart from one another.

2. A drain funnel according to claim 1 and wherein said elongated unitary main body member is coated to prevent the penetration of a material to be drained into said main body member.

3. A drain funnel according to claim 1 and wherein said arcuate elongated unitary body member is U shaped.

4. A drain funnel according to claim 1 and wherein said arcuate elongated unitary body member is V shaped.

5. A drain funnel according to claim 1 and wherein said support means comprise a plurality of cuts and bends.

* * * * *